US006809695B2

(12) United States Patent
Le Bayon et al.

(10) Patent No.: US 6,809,695 B2
(45) Date of Patent: Oct. 26, 2004

(54) SECONDARY REFLECTOR FOR SHF ANTENNAE OF THE CASSEGRAIN TYPE

(75) Inventors: Armel Le Bayon, La Baule (FR); Michael Greiff, Wachtberg-Berkum (DE); Denis Tuau, Trignac (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/768,684

(22) Filed: Feb. 2, 2004

(65) Prior Publication Data

US 2004/0150576 A1 Aug. 5, 2004

(30) Foreign Application Priority Data

Feb. 4, 2003 (FR) ..... 03 01236

(51) Int. Cl.[7] ..... H01Q 13/00
(52) U.S. Cl. ..... 343/781 CA; 343/781 P; 343/782
(58) Field of Search ..... 343/781 CA, 781 P, 343/782, 781 R, 783, 840, 786, 838; H01Q 13/00

(56) References Cited

U.S. PATENT DOCUMENTS 4,626,863 A 12/1986 Knop et al.
4,675,688 A * 6/1987 Sahara et al. ..... 373/765
4,801,946 A 1/1989 Matz
5,973,654 A 10/1999 Karp
6,137,449 A * 10/2000 Kildal ..... 373/781 P

FOREIGN PATENT DOCUMENTS

DE 101 21 643 A 11/2002
EP 1 128 468 A 8/2001

* cited by examiner

*Primary Examiner*—Hoanganh Le
(74) *Attorney, Agent, or Firm*—Sughrue Mion, PLLC

(57) ABSTRACT

The invention concerns the secondary reflectors of SHF antennae of the Cassegrain type.

It consists of providing the secondary basic reflector (103) of this antenna with a first circular ring (104) in the shape of a cylinder directed toward the main reflector, and a second ring (105) in the shape of a circular crown fixed to the end of the cylinder, and projecting outward from the latter. These rings are made from a conducting material. The length of the cylinder and the width of the crown are of the range of one quarter of the average wavelength for which the antenna is dimensioned.

This enables the "overspill radiation" of the secondary reflector to be reduced considerably, and therefore allows the dimensions of the antenna to be reduced significantly for equivalent performance.

4 Claims, 2 Drawing Sheets

SECONDARY REFLECTOR FOR SHF ANTENNAE OF THE CASSEGRAIN TYPE

The present invention relates to secondary reflectors which are used in SHF antennae of the Cassegrain type. These antennae were first used in radar equipment, and are now widely employed in satellite communication systems, especially in individual terrestrial stations.

We are familiar with SHF antennae of the Cassegrain type, in which an SHF source placed on the axis of a main parabolic reflector illuminates a secondary reflector located close to the focus of this main reflector. The SHF wave is then reflected from this secondary reflector to illuminate the main reflector, and this allows a radiation diagram in the shape of a narrow beam to be obtained. This operation is reversed on reception of course.

The presence of the secondary reflector leads to a certain number of undesirable effects.

One of these effects is to mask a part of the surface of the main reflector, thus reducing the efficiency of the latter.

Another of these effects is a loss of part of the radiation reflected by the secondary reflector, which is diverted outside the surface of the main reflector. This "overflow radiation", also known as "spillover radiation", escapes as pure loss behind the antenna.

Great efforts have been exerted in order to reduce these undesirable effects by modifying the reflecting surface of the secondary reflector in relation to the initially hyperbolic shape of the optical Cassegrain telescope from which this type of SHF antenna was developed.

As shown in FIG. 1, a known SHF "source" in such an antenna includes a circular wave guide (101) along which the SHF wave arrives. A hollow dielectric cone (102) is attached to this guide at one end and carries a secondary reflector (103) at the other end. The relatively complex shape of the surface of this reflector corresponds to the known state-of-the-art, so as to enable the aforementioned disadvantages, and the spillover radiation in particular, to be limited.

Even in this case, the dimensions of the secondary reflector, and therefore its masking effect, remain considerable. As a consequence, an increase in the dimensions of the main reflector is required in order to obtain the desired gain and directivity characteristics.

In addition, the overspill radiation that still remains, slight though it may be, reduces the performance of the antenna, and requires that it too must increase in size in correlation with the dimensions of the main reflector.

Now it is increasingly necessary, mainly for reasons of visual effect, to limit the size of antennae of this type, and this in turn requires an increase in the performance of the secondary reflector as well as a reduction in its size.

In order to achieve these effects, the invention proposes a secondary reflector for SHF antennae of the Cassegrain type which includes a basic secondary reflector consisting of a first circular "ring" in the shape of a cylinder made of conducting material, whose diameter is equal to the external diameter of the basic reflector, secured by one of its ends to the outer edge of this basic reflector so as to project from the side of the reflecting surface of the reflector, and whose height (H) is designed to reduce the "overspill radiation" of the secondary reflector.

The invention is characterised in that the reflector also includes a second "ring" in the shape of a circular crown, also made of conducting material, whose inside diameter is equal to the diameter of the first ring, fixed to the free end of this first ring, and with a width (h) that is designed to further reduce the aforementioned overspill radiation.

According to another characteristic of the invention, the values of parameters H and h are of the order of one quarter of the average wavelength for which the antenna is dimensioned.

According to another characteristic of the invention, the first and the second rings are made in the shape of a single full ring of height H' and thickness h', and the reflector consists of a cone made of a solid dielectric material, which connects the waveguide designed to feed into the antenna at the basic reflector, in order to allow the values of parameters H' and h' to be reduced in relation to the values of parameters H and h.

According to another characteristic of the invention, the free end of the single full ring is machined so as to present a cut-away which reduces the thickness of its outer circumference in order to further reduce said overspill radiation.

Other special features and advantages of the invention will appear clearly in the description that follows, which is presented with reference to the appended figures.

Figure 1:
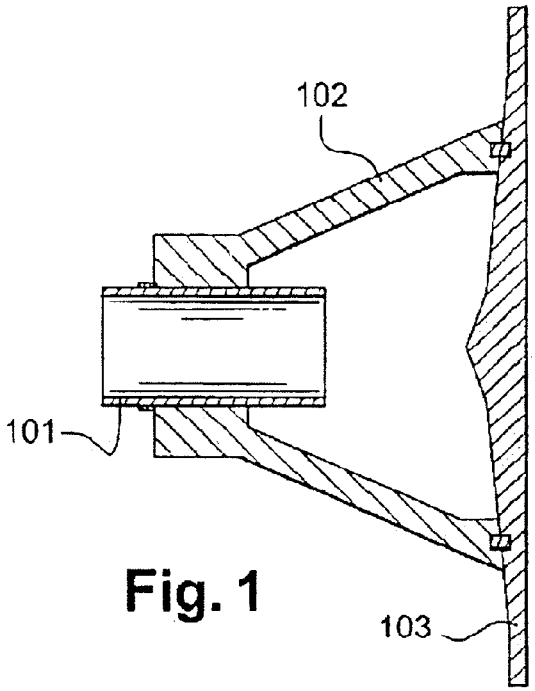
FIG. 1 is a view in section of an SHF source, including a secondary reflector according to conventional design.
Figure 2:
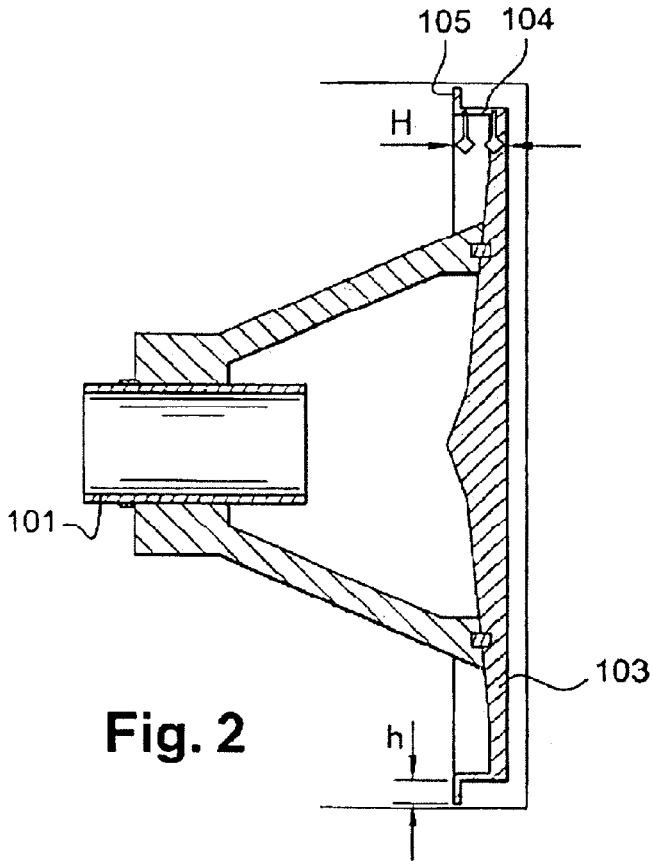
FIG. 2 is a view in section of an SHF source, including a secondary reflector according to the invention.
Figure 3:
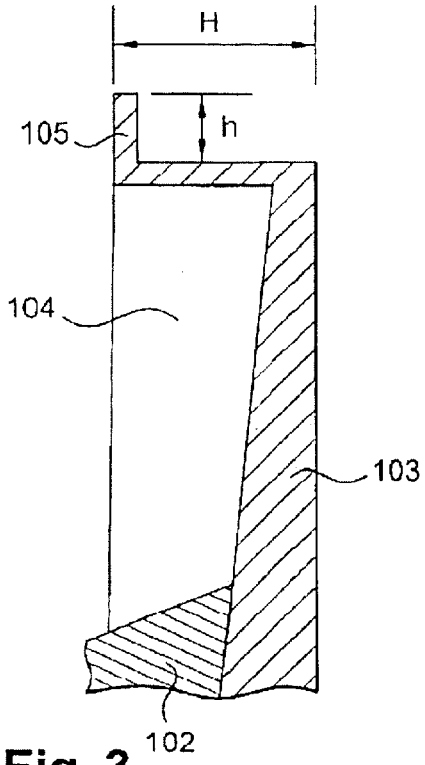
FIG. 3 is an enlarged view of a significant detail of FIG. 2.

According to a first embodiment of the invention represented in section in FIGS. 2 and 3, the SHF source consists of the same elements (101 to 103) as the source according to conventional design as shown in FIG. 1.

The invention proposes to further provide to the secondary basic reflector (103) of a first circular "ring" (104) in the shape of a cylinder of height H and diameter equal to the external diameter of the reflector (103). This ring is made of a conducting material, preferably a metal which can be identical to that forming the secondary reflector (103). It is secured by one of its ends to the outer edge of this reflector, so that it projects from the side of the reflecting surface of the reflector, and therefore in the direction of the waveguide (101). The effect of this ring is essentially to mask the overspill radiation, and to re-direct it toward the effective surface of the main reflector. This results in an increase of the yield of the antenna which, for identical efficiency, allows a substantial reduction in the diameter of the secondary reflector, and therefore the diameter of the main reflector. To facilitate comprehension of the drawings, the sources of FIGS. 1 and 2 have been shown with the same dimensions, and it should be understood that the source of FIG. 2 is shown on a larger scale in the case of identical efficiency. If the sources are physically of the same size, then the efficiency of the antenna using the source of FIG. 2 will be greater.

An improved variant of the invention proposes the addition of a second ring (105) in the shape of a circular crown, also in conducting material and of width h, whose inside diameter is equal to the diameter of the first ring. This crown is fixed to the free end of the first ring.

Edge ring 105 is employed whenever the effect of edge ring 104 is insufficient. In fact, if one attempts to increase the size of edge ring 104 excessively (i.e. more that one quarter of the wavelength) in order to improve a certain part of the radiation diagram, there is a risk that another region of the diagram will deteriorate. Edge ring 105 improves the radiation diagrams while avoiding this disadvantage.

Dimensions H and h are of the order of one quarter of the average wavelength for which the antenna is dimensioned. In the light of the very variable shapes in which the secondary reflector (103) can be made in conventional designs, the exact dimensions of these parameters will be determined by the professional designer by means of some simple tests, beginning with this approximate dimension of one quarter of the wavelength. Given the simple geometrical shapes used by the invention (cylinder and circular crown) these tests require no particular effort.

As an example of implementation, it has been determined that in the 7.1–8.5 GHz band, a height (H) of 14 mm and a width (h) of 9 mm will allow a reduction of the order of 30% of the diameter of the secondary reflector to be obtained for equal performance.

Figure 4:
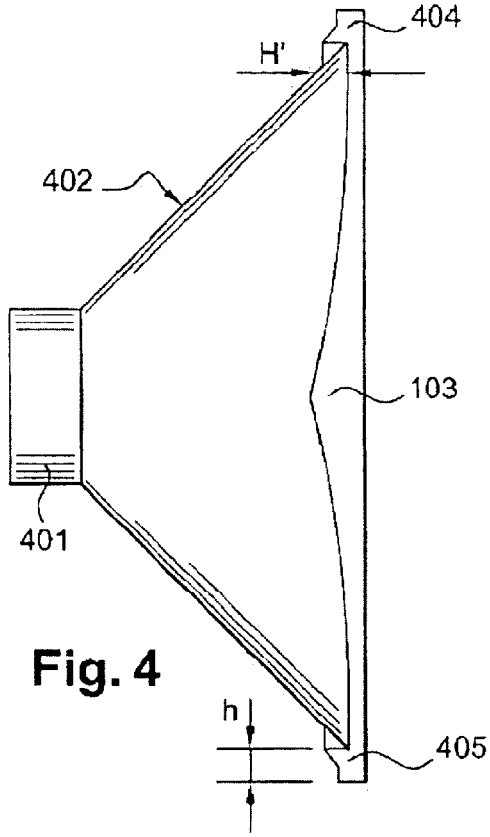
FIG. 4 is a view in section of an SHF source according to a variant of the invention.

In another embodiment of the invention, shown in FIG. 4, the cone (402) which supports the secondary reflector (103) is made from a solid dielectric material which has the effect of reducing the wavelength within this cone. In these conditions, the end of the cone penetrates into the circular waveguide (401), for purely mechanical reasons. The invention then proposes to implement the cylinder/crown assembly of the first embodiment in the form of a single full ring (404) of height H' and thickness h'. In order to obtain the best results, the free end of this ring, namely that turned toward the main reflector, is machined so as to present a cut-away (405) which reduces the thickness of the ring at its outer circumference.

To give a numerical example of this second embodiment, it has been determined that in the 14.2–15.35 GHz band, a height (H') of 2 mm and a thickness (h') of 4 mm would also enable a reduction of the order of 30% to be achieved in the diameter of the secondary reflector, for equivalent performance.

Figure 5:
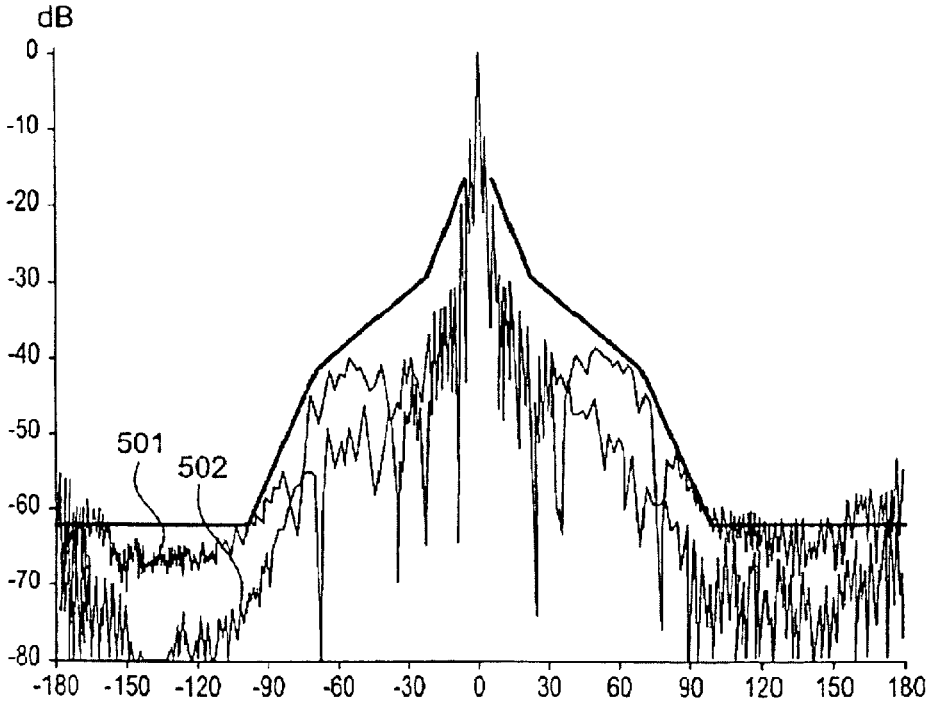
FIG. 5 shows two superimposed radiation diagrams, corresponding to the sources of FIGS. 1 and 2 respectively.

To illustrate this improvement in performance, FIG. 5 shows the radiation diagrams for a conventional antenna (501), and that for an antenna according to the invention (502). It can be seen that the diagram for the antenna according to the invention is distinctly improved, especially in the region corresponding to incidence angles of greater that 30°.

In addition to an improvement in radio performance, the invention also allows a reduction of the visual impact of such antennae, by reducing the dimensions of the main reflector, enabling it to be integrated more easily into the landscape.

What is claimed is:

1. A secondary reflector for SHF antennae of the Cassegrain type with a secondary basic reflector (103), which includes a first circular "ring" (104) in the shape of a cylinder made of conducting material, whose diameter is equal to the external diameter of the basic reflector, secured by one of its ends to the outer edge of this basic reflector so that it extends to the side of the reflecting surface of the reflector, and whose height (H) is designed to reduce the "overspill radiation" of the secondary reflector, characterised in that it also includes a second "ring" (105) in the shape of a circular crown, made of conducting material, whose inside diameter is equal to the diameter of the first ring, fixed to the free end of this first ring and with a width (h) chosen to further reduce said overspill radiation.

2. A reflector according to claim 1, in which the values of parameters H and h are of the order of one quarter of the average wavelength for which the antenna is dimensioned.

3. A reflector according to claim 1, in which the first and the second rings are presented in the form of a single full ring (404) of height H' and thickness h', and which also has a cone (402) made of solid dielectric material, which connects the waveguide (401), intended to feed into the antenna, to the basic reflector so that the values of parameters H' and h' can be reduced in relation to the values of parameters H and h.

4. A reflector according to claim 3, in which the free end of the single full ring (404) is machined so as to have a cut-away (405) which reduces its thickness at the outer circumference so as to further reduce said overspill radiation.

* * * * *